US005802708A

United States Patent [19]

Hill et al.

[11] Patent Number: 5,802,708

[45] Date of Patent: Sep. 8, 1998

[54] HYDROSTATIC EXTRUSION OF CU-AG MELT SPUN RIBBON

[75] Inventors: Mary Ann Hill, Los Alamos; John F. Bingert; Sherri A. Bingert, both of Jemez Springs; Dan J. Thoma, Los Alamos, all of N. Mex.

[73] Assignee: The Regents of The University of California, Oakland, Calif.

[21] Appl. No.: 657,860

[22] Filed: May 30, 1996

[51] Int. Cl.[6] ..... H01R 43/00; C22F 1/02

[52] U.S. Cl. ..... 29/825; 29/599; 148/538; 148/680; 148/684; 505/231; 505/740; 264/461; 264/463

[58] Field of Search ..... 148/538, 680, 148/684; 72/70, 71, 274; 264/461, 463; 505/230, 231, 431, 432, 433, 704, 740, 917, 918; 29/599, 825, 832; 501/1

[56] References Cited

U.S. PATENT DOCUMENTS 4,861,751 8/1989 Tenhoveor .

4,952,554 8/1990 Jin et al. ..... 72/274

5,322,574 6/1994 Sakai et al. ..... 148/538

FOREIGN PATENT DOCUMENTS

589609A1 9/1993 European Pat. Off. ..... C22F 1/108

*Primary Examiner*—W. Donald Bray

*Attorney, Agent, or Firm*—Milton D. Wyrick; William A. Eklund

[57] ABSTRACT

The present invention provides a method of producing high-strength and high-conductance copper and silver materials comprising the steps of combining a predetermined ratio of the copper with the silver to produce a composite material, and melt spinning the composite material to produce a ribbon of copper and silver. The ribbon of copper and silver is heated in a hydrogen atmosphere, and thereafter die pressed into a slug. The slug then is placed into a high-purity copper vessel and the vessel is sealed with an electron beam. The vessel and slug then are extruded into wire form using a cold hydrostatic extrusion process.

7 Claims, 4 Drawing Sheets

HYDROSTATIC EXTRUSION OF CU-AG MELT SPUN RIBBON

This invention was made with Government support under Contract No. W-7405-ENG-36 awarded by the U.S. Department of Energy. The Government has certain rights in the invention.

FIELD OF THE INVENTION

The present invention generally relates to the fabrication of electrically conductive wire and cable, and, more specifically, to the fabrication of high strength and high conductance wire and cable.

High strength, high conductance (HSHC) materials are useful in a great many areas. Among these areas are high field pulsed magnets, high efficiency motors, medical sensors, and many other electrical conductor applications. High strength materials are fabricated easily, but their low conductivity makes them unsuitable as electrical conductors.

It is well known that copper-silver (Cu-Ag) alloys exhibit both high strength and high conductivity when heavily worked, using techniques such as wire drawing and rolling. The Cu-Ag alloy system was first used in the exploration of rapid solidification techniques. This alloy system was considered because it does not obey the Hume Rothery rules which predict complete miscibility of the copper and silver. Instead, the Cu-Ag system is a simple eutectic system in which the two solids have the same face centered cubic structure, resulting in a single metastable miscibility gap.

The Cu-Ag alloy system particularly is beneficial for use in high field magnets. This is true because the applications require conductors which exhibit good conductivity for minimizing the temperature rise due to the flow of current in the coil, and high strength for withstanding the Lorentz forces produced by the magnetic field.

A process developed in Japan has produced high strength, high conductivity (HSHC) Cu-Ag materials, using continuous casting and cold drawing with intermediate heat treatments. By this conventional method of processing, a yield strength (YS) level of 0.9 GPa, with a conductivity of 80% IACS (International Annealed Copper Standard) has been achieved in materials undergoing a reduction in area (RA) of 99%.

The Japanese procedure developed by Showa Industries of Japan produces Copper-Silver wire using conventional techniques which include continuous casting, hot forging, drawing to RA=40%, heat treating, drawing to RA=75%, heat treating, and drawing to RA=99%.

The technique of the present invention, in contrast, involves only melt spinning, die pressing and hydrostatic extrusion. This allows the present invention to provide a method of producing HSHC materials having properties much improved over the prior art. Additionally, the present process provides HSHC materials in a simpler procedure and more cost effectively than the prior art.

It is therefore an object of the present invention to provide a method for producing high-strength and high-conductance materials through a more efficient procedure than the prior art.

It is another object of the present invention to provide a method for producing high-strength and high-conductance materials having improved strength and electrical conductance properties.

It is yet another object to provide a method for producing high-strength and high-conductance materials in a very cost effective procedure.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the present invention, there is provided a method of producing high-strength and high-conductance copper and silver materials comprising the steps of combining a predetermined ratio of the copper with the silver to produce a composite material, and melt spinning the composite material to produce a ribbon of copper and silver. The ribbon of copper and silver is heated in a hydrogen atmosphere, and thereafter die pressed into a slug. The slug then is placed into a high-purity copper vessel and the vessel is sealed with an electron beam. The vessel and slug then are extruded into wire form using a cold hydrostatic extrusion process.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides a method of producing high-strength and high-conductance (HSHC) having characteristics superior to those of the prior art. The invention also produces the superior HSHC material in a more cost effective manner than does the prior art.

The present invention uses a process beginning with rapid solidification of the starting materials, copper and silver. This rapid solidification is accomplished by the melt spinning process, and serves to produce a ribbon of Cu-Ag material which is refined to a structure of approximately 1 $\mu$m. This structure compares most favorably with the 10–20 $\mu$m structure achieved with the continuous casting process of the prior art. This refinement with the present invention is important because it directly relates to increased strength, even though it also is associated with decreased conductivity. The present invention overcomes this possible decrease in conductivity later in the process.

Figure 1A:
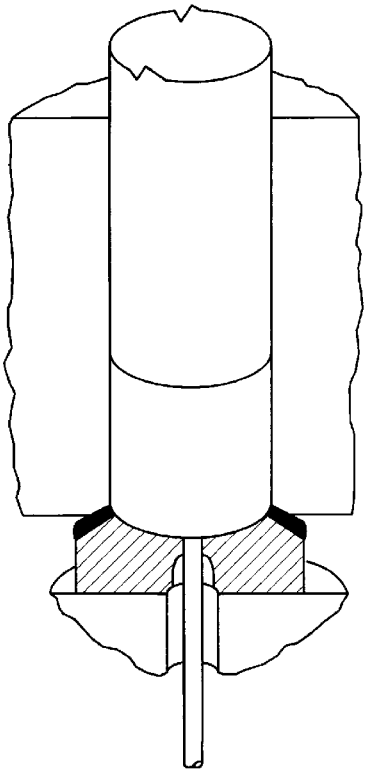
FIG. 1 is a comparison between the conventional apparatus for extruding wire and the hydrostatic apparatus used with the present invention.
Figure 1B:
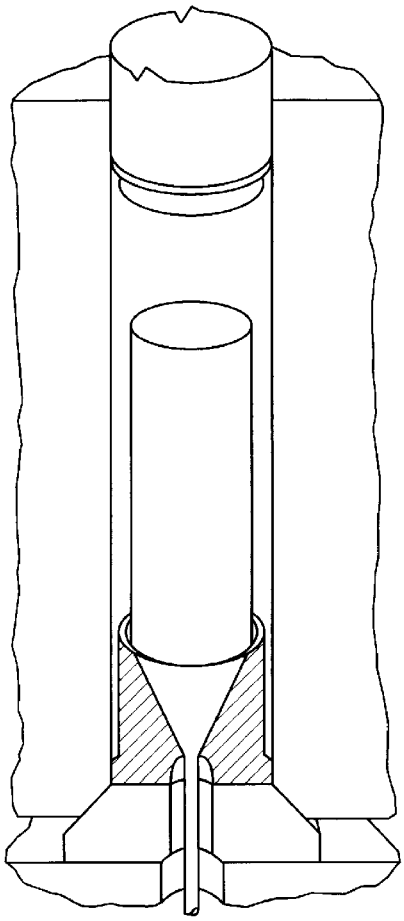

The ribbon produced by melt spinning is then consolidated by cold pressing and formed into a rod by hydrostatic extrusion. As shown in FIG. 1, hydrostatic extrusion, illustrated at b, differs from conventional extrusion, illustrated at a, in that, with hydrostatic extrusion, billet 11 is extruded through a pressure medium. One of the important features of hydrostatic extrusion is its ability to achieve larger reductions at lower temperatures for a given press capacity. Also, the elimination of tensile stresses in the extrusion process results in improved densification compared to wire drawing. This lower temperature is particularly important when working with the copper-silver composite, because this composite does not retain its strength following annealing. Further, hydrostatic extrusion is especially appropriate in the processing of composites due to the inherent reduction in container and die friction and the use of low-angle dies, contributing to a more uniform flow of material during extrusion.

The actual production of the Cu-Ag HSHC material, through use of the apparatus illustrate in FIG. 1 at b, can be best understood through an example of the process of the present invention. The example will illustrate clearly the improvement over the prior art provided by the invention.

EXAMPLE

A Cu-16 at. % Ag finger chill casting, 1.5 cm in diameter and 16.6 cm long was used as the starting material for the melt spun ribbon step. The copper and silver used were both 99.99% pure. The alloy was then arc melted and loaded into a ceramic crucible with an orifice diameter of 0.71 mm. The melt spinning chamber was evacuated to a level of 1.33 $N/m^2$ (10 mtorr) and back-filled with ultra-high purity helium three times. The operating pressure in the melt spinning chamber was $1.69\times10^4$ $N/m^2$ (0.2 atm). Through the use of induction heating, the Cu-Ag alloy was heated over a five (5) minute period to a pour temperature of 1100° C., a superheat of 130° C.

The molten alloy then was ejected by a helium gas pressure of $2.76\times10^4$ $N/m^2$ (4 psi) onto a chilled copper wheel 33 cm in diameter. The copper wheel was rotating at 2000 rpm. Ninety grams of 75 micron thick alloy ribbon was collected at the end of a 1.3 m tube. This represented a 95% conversion of the original alloy charge into ribbon.

The ribbon then was reduced in flowing hydrogen at a temperature of 285° C. for a period of four (4) hours in order to remove any oxide which might have formed on the surface of the alloy ribbon during the melt spinning operation. Following this reduction in hydrogen, no change was noted in the microstructure of the ribbon. Next, six (6) grams of the alloy ribbon were removed and cold pressed at 3038 GPa using a 6.4 mm die. The pressing was 96.1% of the theoretical density.

The hydrostatic extrusion billet was fabricated from C10100 copper rod, 9.5 mm diameter, with a 40° included nose angle to match the approach angle of the die. The 6.4 mm diameter Cu-Ag pressing was sealed inside the billet by electron-beam welding. Additional lubrication was applied to the surface of the billet using $MoS_2$.

Hydrostatic extrusion was performed using an INNOVARE® LES system incorporating a 12.7 mm pressure chamber and peanut oil at ambient temperature as the pressure medium. The reductions were executed in two (2) steps, with a total extrusion ratio, R, of 14 (where $R=A_o/A$). This is equivalent to a true strain ($\epsilon$) of −2.6.

The first extrusion reduced the billet from its original diameter of 9.5 mm to 4.8 mm (R=4) at a breakthrough pressure of 985 MPa. The second extrusion, also employing a 40° nose angle, further reduced the billet from 4.8 mm to 2.5 mm (R=3.5) at a pressure of 1190 MPa. The increased pressure associated with the second extrusion most likely was due to further consolidation of the alloy ribbon, and work-hardening of the copper can from the initial reduction.

Slip-stick conditions were observed during both extrusions, indicative of unstable boundary lubrication conditions. Adiabatic heat generation associated with deformation work increases the actual billet temperature during extrusion. Using standard estimation procedures, the estimated temperature change for R=4 yields $\Delta T=160$ K, and an exit temperature of 185° C.

Both transverse and longitudinal sample sections of the as-spun ribbon and extrusion were mounted in epoxy in preparation for metallographic examination. The sample then was etched with ferric chloride, which attacks the copper but not the silver. The etched samples were viewed on a JEOL® 6300 FXV field emission SEM at 20–25 kV. Microhardness measurements were taken on a SCHIMADZU® microhardness tester at a load of 300 grams. Sub-scale compression samples 2.54 mm in diameter and 3.13 mm long were machined to 0.03 mm and tested on an INSTRON 1125®. Resistance values were measured using a four-wire dc method and read from a KEITHLY® nanovoltmeter. The accuracy of the sample resistance was ±0.1%. However, the accuracy of the resistivity was ±1.0% because of cross-sectional area and voltage tap separation measurement inaccuracies.

Figure 2:
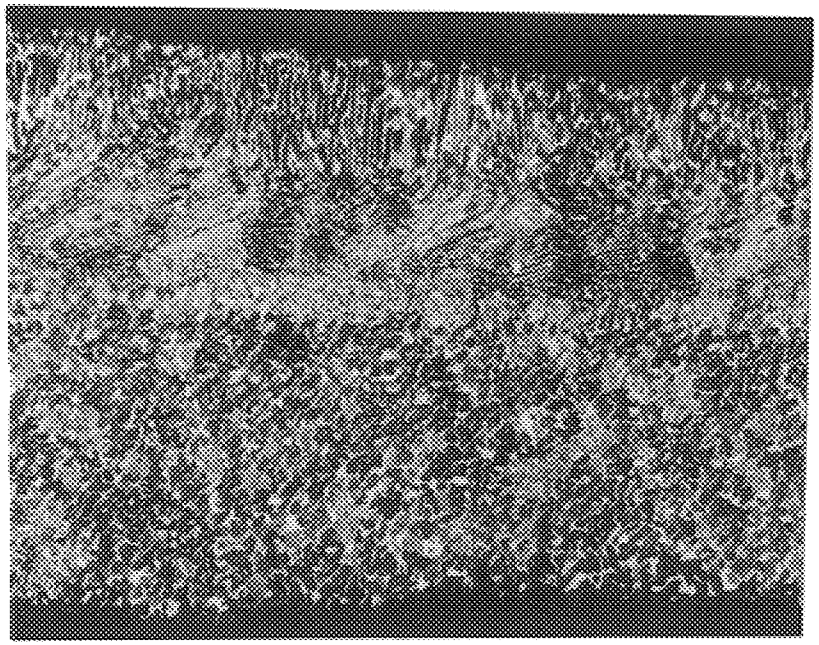
FIG. 2 is a reproduction of a photomicrograph of a transverse section of as-spun ribbon.

Optical metallography conducted on the as-spun ribbon revealed three different morphological regions: a columnar structure near the chilled surface, a banded microstructure in the center of the ribbon, and an equiaxed area near the free surface. This is clearly shown in the reproduction of the optical metallography in FIG. 2 at a magnification of 1000×. These various microstructures result from a decrease in the cooling rate from the chilled surface to the upper surface of the ribbon. The banded structure has been observed by others in Ag-Cu spun ribbon, and has been attributed to a helical-type growth pattern.

Figure 3:
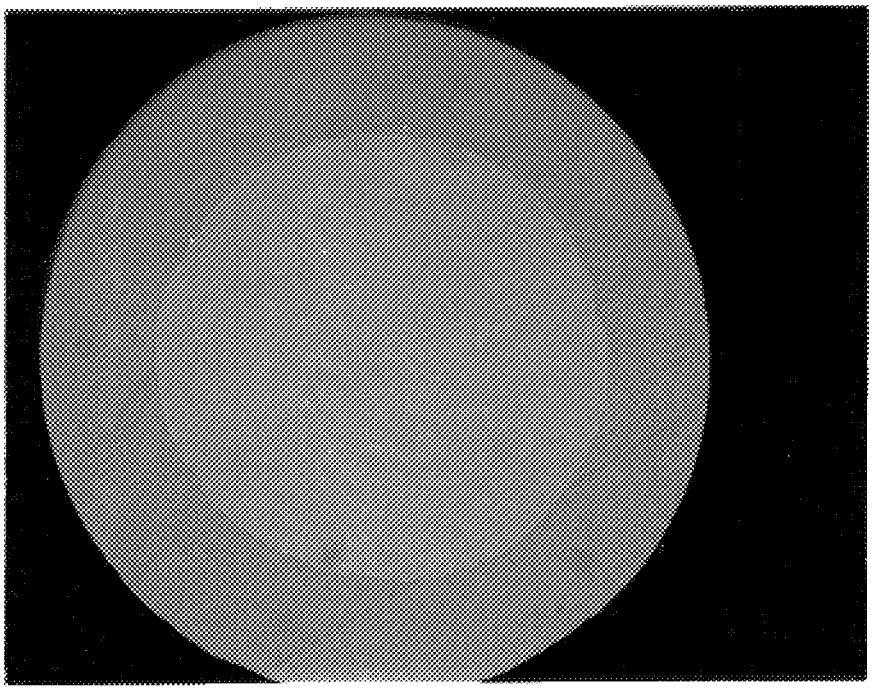
FIG. 3 is a reproduction of a photomicrograph of a transverse section of consolidated ribbon.

The transverse sections of the as spun ribbon and extrusion were subjected to optical metallography which revealed a composite material consisting of an 84% copper-silver core surrounded by 16% pure copper, previously having been the copper can. As shown in FIG. 3, at 1000× magnification, the transverse sections displayed no porosity in the Cu-Ag core. The extrusion in this example was accomplished without the application of any heat to insure that no coarsening of the microstructure would occur. Filaments, approximately one-hundred nanometers in length, were observed in the microstructure of the consolidated sections.

The resistivity of the prepared samples at room temperature was determined to be 2.02 $\mu$ohm-cm, or 86% of the International Annealed Copper Standard (IACS). The resistivity at the temperature of liquid nitrogen was determined to be 0.34 $\mu$ohm-cm, resulting in a resistivity ratio of $\rho_{77K}/\rho_{296K}$ of 5.94.

High field pulsed magnets are cooled to liquid nitrogen temperature prior to being energized in order to minimize resistive losses. During the pulse, the magnet conductor will reach a temperature of approximately 200K. A high resistivity ratio, as is provided by the present invention, is desirable in this application because the operating temperature of the magnet is below room temperature. The resistivity ratio of the hydrostatically extruded copper-silver alloy according to the present invention compares favorably with other conductors used for high field magnet applications, and is almost twice the resistivity ratio of conventionally processed copper-silver conductors. The high resistivity ratio provided by the present invention results from the thick outer layer of copper in the extruded material.

Figure 4:
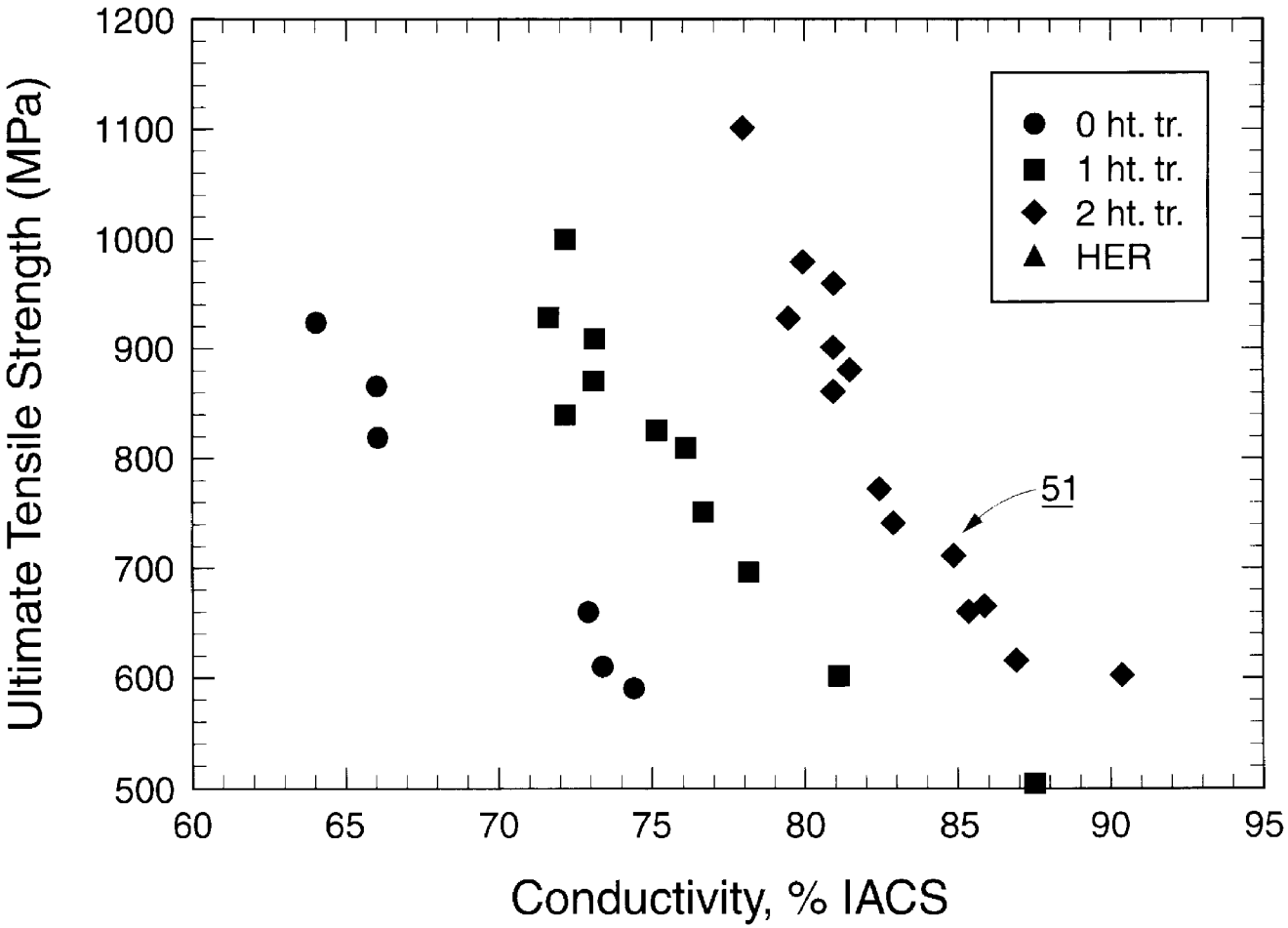
FIG. 4 is a plot comparing the ultimate tensile strength versus conductivity for HSHC Cu-Ag wire of the prior art with a point indicating the yield strength for HSHC Cu-Ag wire produced with the method of the present invention, because ultimate tensile strength testing has not been obtained for the current invention.

Yield strength values, determined by compression testing, indicate that the Cu-Ag material produced according to the method of the present invention exceeded those of conventionally processed Cu-Ag material. This is shown in FIG. 4, where ultimate tensile strength versus conductivity is plotted for the Showa Industries wire for various lengths of heat treatment. One data point 51 illustrates the yield strength determined for the present invention. While not representing ultimate tensile strength, data point 51 nonetheless clearly illustrates the superior characteristics of wire produced by the method of the present invention. Previous experience has shown that good agreement exists between tension testing and compression testing of Cu-Ag materials.

The present invention demonstrated that HSHC materials with properties superior to those of the prior art can be obtained through rapid solidification techniques to refine the grain structure. In this invention, this is accomplished through melt spinning, and consolidating the Cu-Ag material by die pressing and hydrostatic extrusion to form conductor wire or rod. The resulting material, with a RA of 93%, has a conductivity of 86% IACS. Its yield strength is 0.8 GPa, with a microstructure on the order of 100–200 nm. The combination of melt spinning, cold hydrostatic extrusion of the pressed Cu-Ag ribbon, and the presence of the outer copper shell yields a higher strength and a higher conductivity than has been achieved by the prior art.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of producing high-strength and high-conductance copper and silver materials comprises the steps of:

combining a predetermined ratio of said copper with said silver to produce a composite material;

melt spinning said composite material to produce a ribbon of copper and silver;

heating the said ribbon in a hydrogen atmosphere;

die pressing said ribbon into a slug;

placing said slug into a high-purity copper vessel and sealing said vessel with an electron beam;

extruding said vessel and slug into wire form using a cold hydrostatic extrusion process.

2. The method according to claim 1 wherein said predetermined ratio comprises copper-16 at. % Silver (Cu-16 at. % Ag).

3. The method according to claim 1 wherein step of heating said ribbon in a hydrogen atmosphere heats said ribbon to a temperature of 285° C.

4. The method according to claim 1 wherein step of melt spinning said copper and silver produces a ribbon of said copper and silver having a microstructure of approximately 1 $\mu$m.

5. The method according to claim 1 wherein step of die pressing said ribbon produces a slug having a density of approximately 95%.

6. The method according to claim 1 wherein said extruded wire form has a yield strength of 0.8 GPa.

7. The method according to claim 1 wherein said extruded wire form has a conductivity of approximately 86% IACS.

* * * * *